US010328323B2

(12) United States Patent
Florentino

(10) Patent No.: US 10,328,323 B2
(45) **Date of Patent: *Jun. 25, 2019**

(54) PROJECTILE AND TARGET GAME

(71) Applicant: Game Innovation, LLC, Lynnfield, MA (US)

(72) Inventor: Edward Francis Florentino, Saugus, MA (US)

(73) Assignee: Game Innovation, LLC, Lynnfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/984,335

(22) Filed: May 19, 2018

(65) Prior Publication Data

US 2018/0264336 A1 Sep. 20, 2018

Related U.S. Application Data

(63) Continuation-in-part of application No. 15/723,256, filed on Oct. 3, 2017.

(60) Provisional application No. 62/403,762, filed on Oct. 4, 2016.

(51) Int. Cl.

| | |
|---|---|
| ***A63B 67/06*** | (2006.01) |
| ***A63B 65/00*** | (2006.01) |
| ***A63B 71/00*** | (2006.01) |
| *A63B 71/06* | (2006.01) |

(52) U.S. Cl.

CPC ..... *A63B 67/06* (2013.01); *A63B 65/00* (2013.01); *A63B 71/0036* (2013.01); *A63B 71/0672* (2013.01); *A63B 2067/061* (2013.01); *A63B 2071/0694* (2013.01); *A63B 2209/08* (2013.01)

(58) Field of Classification Search

CPC ..... A63D 3/00; A63D 9/00

USPC ..... 273/456, 448, 443, 239, 348.3, 118 A; 473/118–122, 102, 85

See application file for complete search history.

(56) References Cited

U.S. PATENT DOCUMENTS

| | | | | | |
|---|---|---|---|---|---|
| 846,372 | A * | 3/1907 | Lemieux | A63D 9/00 | 473/118 |
| 972,568 | A * | 10/1910 | Noonan | A63D 3/00 | 473/102 |
| 1,516,154 | A * | 11/1924 | Lemieux | A63D 9/00 | 473/124 |
| 2,014,306 | A * | 9/1935 | Barker | A63D 5/04 | 473/102 |
| 2,701,719 | A * | 2/1955 | Di Pierro | A63D 9/00 | 156/293 |
| 2,848,235 | A * | 8/1958 | Johns | A63D 5/06 | 235/145 R |
| 3,039,771 | A * | 6/1962 | Bablouzian | A63B 71/0009 | 273/DIG. 27 |
| 3,463,490 | A * | 8/1969 | Annessa | A63D 3/00 | 473/102 |
| 3,764,136 | A * | 10/1973 | Breslow | A63D 3/00 | 273/129 R |
| 3,975,014 | A * | 8/1976 | Ryan | A63D 5/08 | 473/54 |

(Continued)

*Primary Examiner* — Mark S Graham

(74) *Attorney, Agent, or Firm* — Law Offices of Daniel A. Tesler, LLC

(57) ABSTRACT

The present invention is a projectile and target lawn game that calls to mind the sport of bowling. The lawn game disclosed herein uses a number of pins that are magnetically attracted to a board as the target. The projectiles are preferably beanbags that a player tosses at the pins.

2 Claims, 10 Drawing Sheets

(56) References Cited

U.S. PATENT DOCUMENTS

| | | | | | |
|---|---|---|---|---|---|
| 4,330,130 | A * | 5/1982 | Carr | ..... | A63F 9/0204<br>206/315.1 |
| 2013/0337946 | A1 * | 12/2013 | Khan | ..... | A63B 63/00<br>473/498 |

* cited by examiner

PROJECTILE AND TARGET GAME

CROSS REFERENCE TO RELATED APPLICATIONS

This application is a continuation-in-part of U.S. Non-provisional patent application Ser. No. 15/723,256 filed Oct. 3, 2017, which claims the benefit of U.S. Provisional Patent Application No. 62/403,762 filed Oct. 4, 2016, both of which are hereby incorporated by reference in their entirety.

FIELD OF THE INVENTION

The present invention relates to games, in particular, to games using projectiles and targets.

BACKGROUND OF THE INVENTION

Lawn games are a popular pastime for many and have increased in popularity over the past decade. Lawn games can include traditional offerings, such as horseshoes or croquet. More recent lawn games include cornhole, a bean bag toss game, and ladderball, a game where two balls connected by a string are tossed at a ladder-like target. Bowling has been a popular indoor sport for many years, however, it requires a precision built facility even for casual play. Indoor bowling requires, at a minimum, a flat wooden surface of a particular width and length, a particular number of bowling pins setup in a prescribed pattern and bowling balls within certain size and weight constraints. Because bowling requires the use of a flat wooden surface and the accurate placement of the bowling pins prior to play, the game of bowling has not translated well into a lawn game.

While lawn games that mimic bowling do exist in the prior art, all of these prior art games have significant drawbacks, reducing their appeal to many. First off, lawn games are not played on perfectly flat or level surfaces, unlike the flat surface of an indoor bowling alley. Uneven ground or grass can make it difficult to set up the bowling pins in a precise pattern and make it nearly impossible to set up the bowling pins substantially normal to the horizontal plane. The uneven ground or grass also have an effect on the path of a bowling ball when rolled, causing the bowling ball to roll along inconsistent and unpredictable paths. Also, where indoor bowling alleys use automated bowling pin resetting machines, in the existing prior art lawn bowling games, the players are expected to manually reset the bowling pins which is a tedious process.

Therefore, there is a need for a lawn game that has the appeal of indoor bowling, while being practical and enjoyable to play outdoors. Accordingly, it is an object of this invention to provide a lawn game that calls to mind aspects of bowling. It is also an object of this invention to provide a method of using the lawn game of the present invention to maximize player enjoyment.

BRIEF SUMMARY OF THE INVENTION

The present invention provides a projectile and target lawn game that calls to mind some aspects of bowling. In the first exemplary embodiment of the invention as described in detain herein, the present invention uses a target, comprised in part by a flat surface that is substantially parallel to the ground and raised slightly off the ground. The flat surface has a multitude of magnets embedded in its surface, each corresponding to a location where a bowling pin is to be set.

The bowling pins have magnets near their base, with their poles oriented to create an attraction to the magnets embedded in the flat surface.

The projectile used in the present invention is a soft sided object that is lobbed at the target rather than rolled, as in a standard game of bowling. The projectile is preferably a beanbag, however, it is appreciated that many different types of projectiles could be suitable.

The present invention also provides a method of using the aforementioned lawn game. The preferred method of using the first exemplary embodiment of the invention involves using an arrangement of ten bowling pins standing on the flat surface in a triangular pattern, where the magnet at the base of each pin is attracted to a magnet embedded in the flat surface. The game requires at least one player, but many more can play in a single game. The game is played for ten rounds or frames, although the number of rounds may be adjusted to suit the number of players and amount of time available for play. The bowling pins are set upright in the triangular pattern for each player in each round and each player has three beanbags to toss at the standing bowling pins. The player's score is equal to the number of pins that are knocked down after tossing three beanbags. If the pins are knocked down with fewer than three beanbags, the player receives an increase in their score in a future round, similar to the rules of bowling.

The embodiments presented in this application are optimized for a projectile and target lawn game that calls the sport of bowling to mind, however, it is appreciated that the invention can be altered to call to mind other sports, activities or a story within the inventive concept expressed herein.

DETAILED DESCRIPTION OF THE INVENTION

The invention will be illustrated in more detail with reference to the following embodiments, but it should be understood that the present invention is not deemed to be limited thereto.

Figure 1:
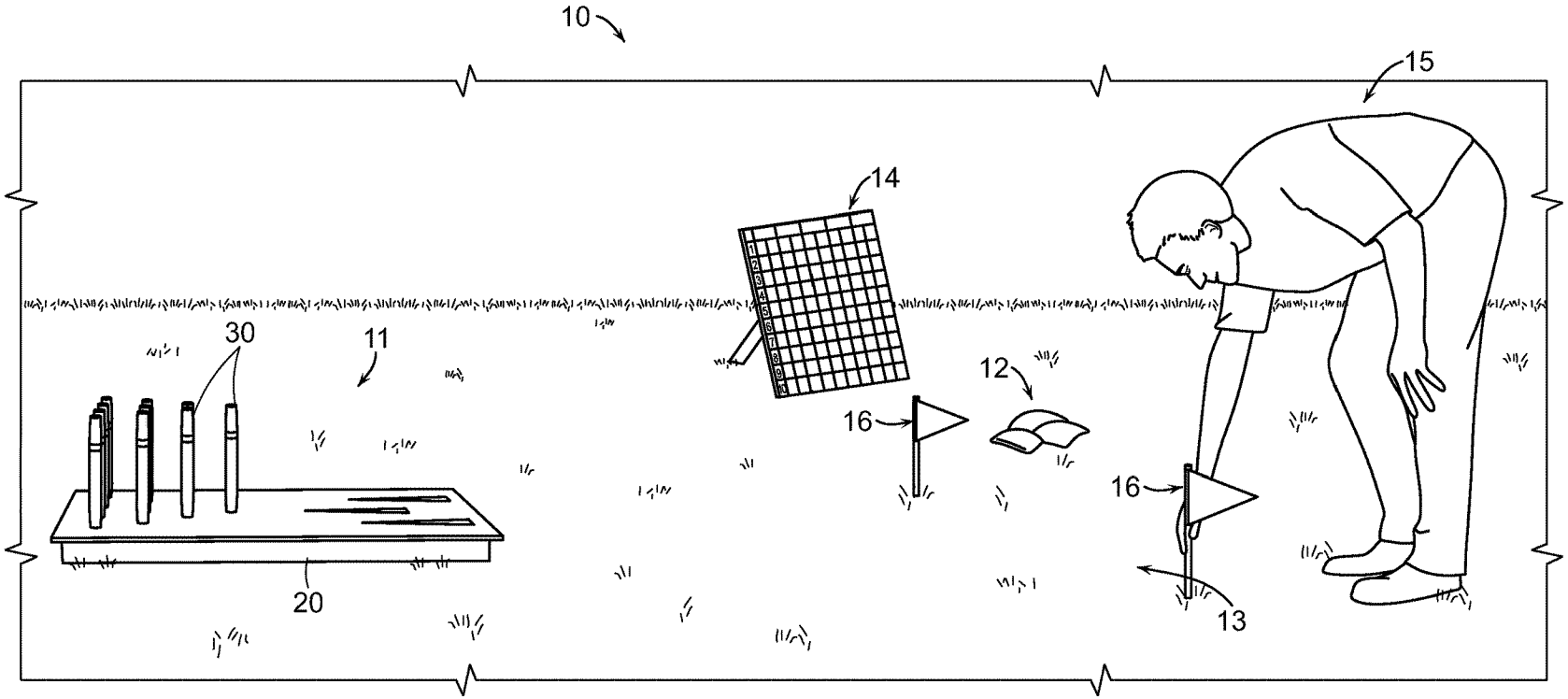
FIG. 1 is a side elevation view of a first embodiment of the invention being used by a first player.
Figure 2:
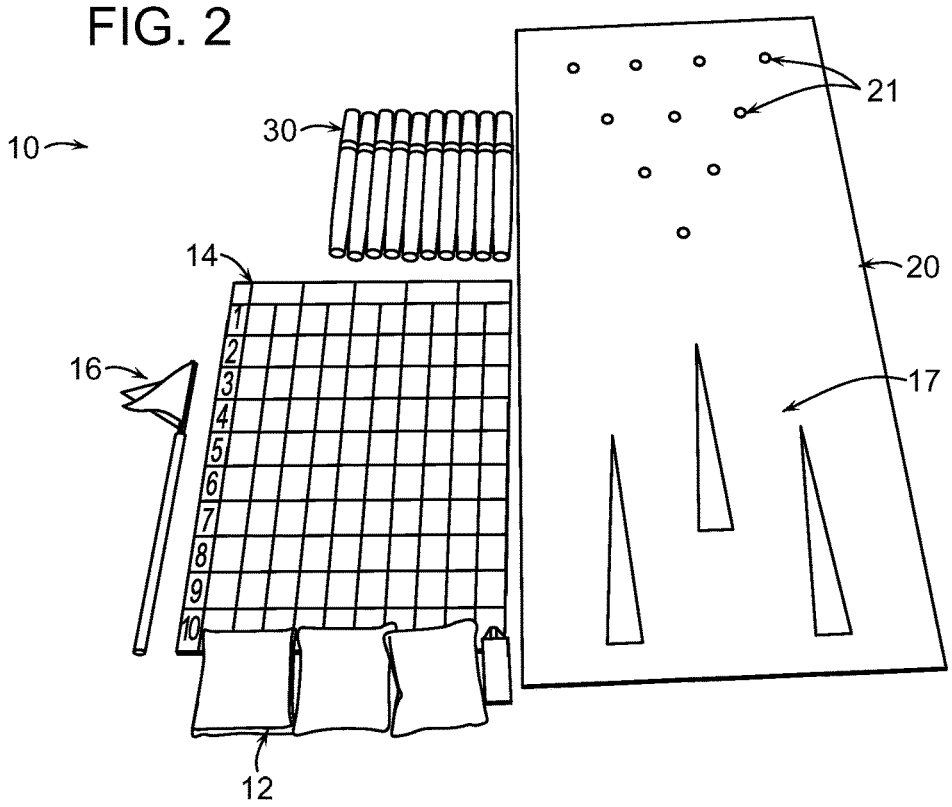
FIG. 2 is a front elevation view of a first embodiment of the invention.
Figure 3:
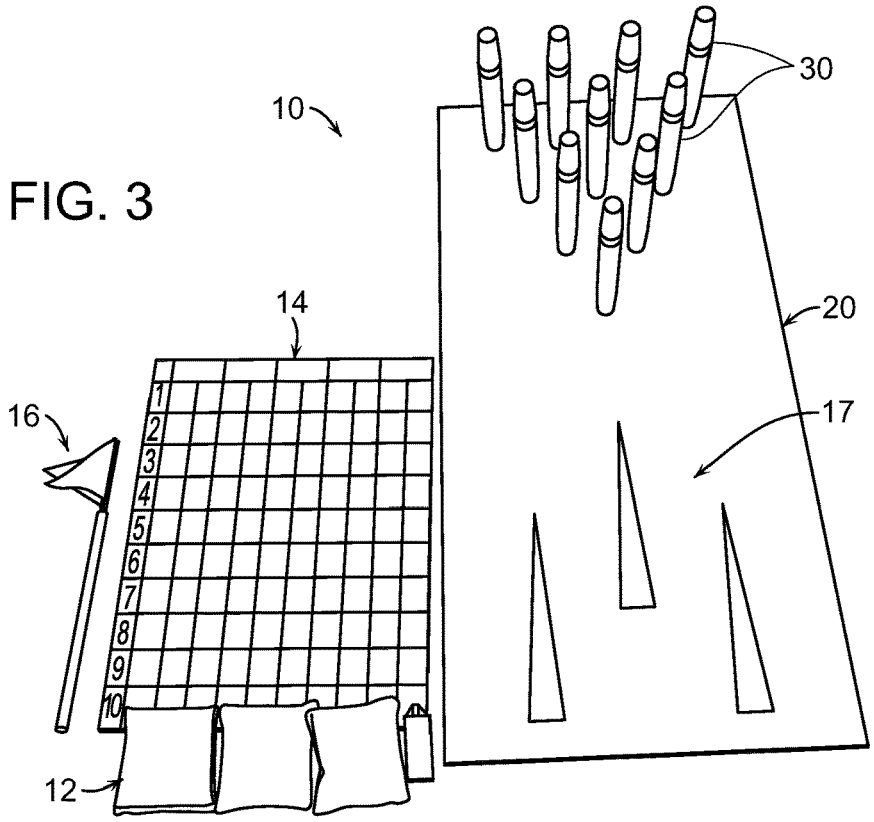
FIG. 3 is a front elevation view of a first embodiment of the invention with the pins set up on the board.

Referring now to the drawing figures, wherein like part numbers refer to like elements throughout the several views, there is shown in FIGS. 1-3, a projectile and target game 10 (hereinafter, the "game") in accordance with a first embodiment of the present invention. The game comprises a target portion 11, a number of projectiles 12, a foul line 13 marked on either end with a flag 16, a scoreboard 14 and one or more player 15. The target portion 11 is further comprised of game board 20 and a plurality of pins 30. The pins 30 can also be referred to as targets as they are the objects that a player attempts to knock over using the projectiles. The target portion of the first embodiment of the present invention calls to mind the appearance of bowling pins set up on a bowling alley, but it is appreciated that many variations would be within the inventive concept of the present invention. The target portion could be designed to call to mind various sports, including but not limited to, different versions of the game of bowling, baseball, basketball, football, hockey, soccer, lacrosse or field hockey. The target portion could also be designed using a non-sports theme, including but not limited to, characters from a book, characters from a show, characters from a movie, characters from a comic, characters from a game, characters from another source, recognizable objects or buildings from fictional works or recognizable objects or buildings from one or more location. In some embodiments, the foul line 13 is adjustable in distance relative to the game board 20. Changing the distance of the foul line 13 relative to the game board 20 can change the difficulty of the game 10.

In FIG. 2, the game 10 is shown with its components spread out, prior to being set up for play. The top of the game board 20 can be seen in this view, including marks 21 indicating the location where each pin 30 should be placed. The pins 30 and game board 20 are magnetized so that the base of the pins 30 are attracted to the game board 20 at the location of the marks 21. In the first exemplary embodiment of the invention, there is a personalization area 17 on the game board 20. In the drawings, three triangles are shown in the personalization area 17, however, it is appreciated that there are an infinite number of images that could be reproduced on this area of the game board 20. Although the personalization area 17 refers to personalization, this area could be personalized for a single consumer or for multiple consumers using the same image. Images that could be printed or otherwise fixed to the personalization area 17 include but are not limited to, sports team names and/or logos, school names and/or logos, company names and/or logos, photographs and other artistic works. In FIG. 3, the pins 30 have been setup for play on the game board 20.

The personalization area 17, in some embodiments, is oriented towards the user during play. The personalization area 17 can also be referred to as the proximate area of the game board 20 based on its position relative to the user during play. The end of the game board 20 opposite the proximate area in the elongate direction can be referred to as the distal area of the game board 20. In some embodiments, the game board 20 further comprises a perimeter defined by an edge face, where the edge face comprises a surface that is substantially normal to the planar upper surface of the game board 20. In some embodiments, a proximate end of the game board 20 oriented towards the user further comprises an edge face that comprises a surface that is normal to the planar upper surface. In some embodiments, a proximate portion of the game board 20 further comprises a perimeter defined by an edge face, wherein the edge face further comprises a substantially planar surface that is substantially normal to the planar upper surface and substantially parallel to a foul line positioned between the edge face and the user. The edge faces described herein refer to the edges of the game board 20 oriented in a lateral direction relative to the planar upper surface, the edges which are visible in FIGS. 4-7. The edge faces are shown as substantially normal to the planar upper surface of the game board 20 in the exemplary embodiments disclosed herein, however, the orientation of the edge faces relative to the planar upper surface can be modified within the inventive concept to change the reaction between the projectile 12 and the game board 20.

Figure 4:
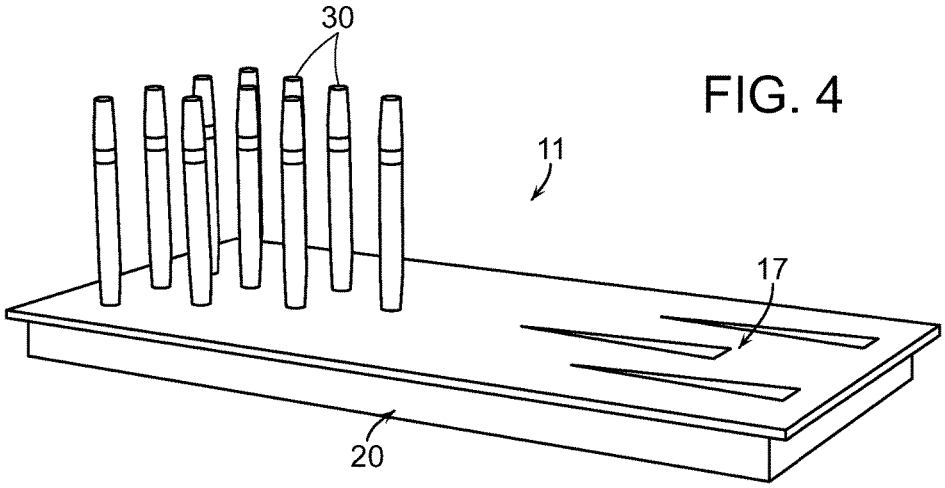
FIG. 4 is an isometric view of a first embodiment of the game board with the pins set up.
Figure 5:
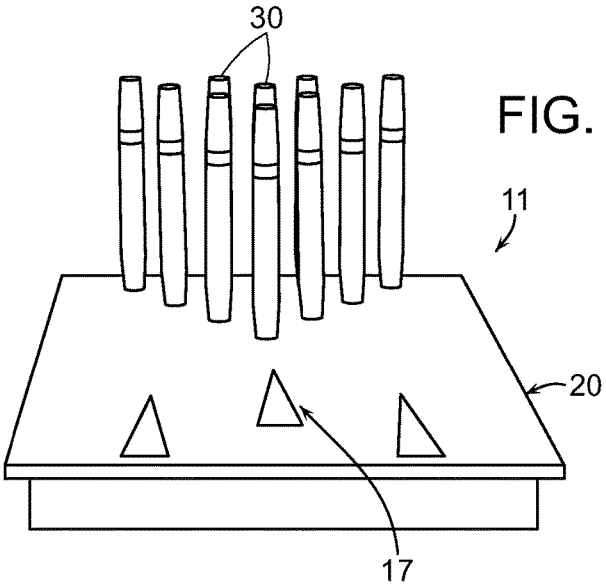
FIG. 5 is front elevation view of a first embodiment of the game board with the pins set up.
Figure 6:
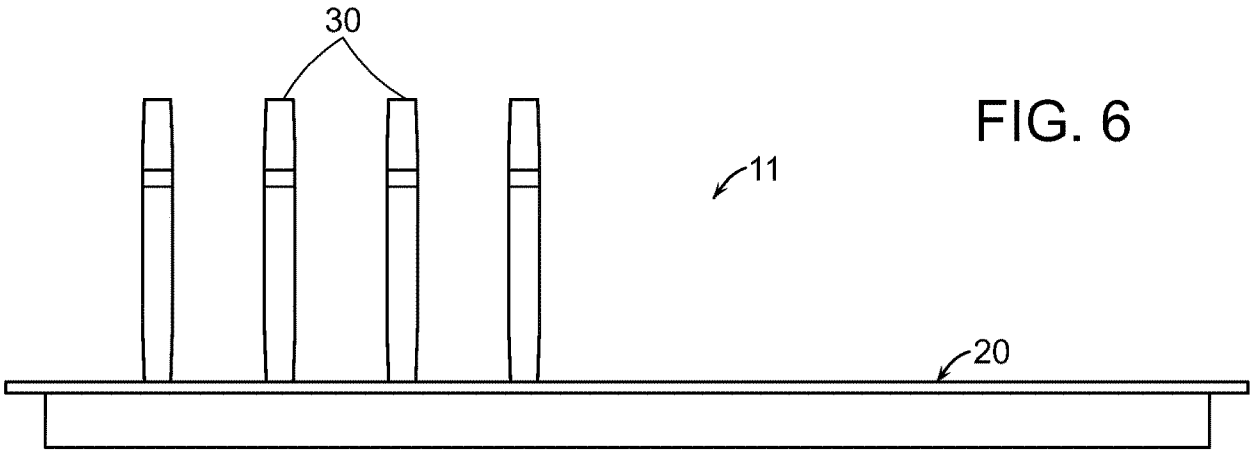
FIG. 6 is a side elevation view of a first embodiment of the game board with the pins set up.

FIGS. 4-6 show the target portion 11 of the game 10 with the pins 30 set up on the game board 20. In the first embodiment of the invention, the target portion 11 of the game 10 is designed to call to mind the game of candlepin pin bowling. Similar to candlepin bowling, the first embodiment uses ten pins 30 setup for play in a triangular pattern, with a point of the triangle oriented towards the player 15. In the first embodiment, the pins 30 are arranged in rows of increasing quantity moving away from the player 15. The first row has one pin 30, the second row has two pins 30, the third row has three pins 30 and the fourth row has four pins 30, for a total of ten pins. While the first embodiment of the game 10 uses ten pins arranged in the aforementioned configuration, it is appreciated that the number of pins may be increased or decreased and the configuration of the pins may be changed within the inventive concept described herein. It would be possible to play the game 10 with as few as a single pin 30. A single pin 30 version of the game 10 could be desirable for a youth focused game where a child may have difficulty knocking down a plurality of pins 30. It would also be possible to play this game 10 with any number of pins 30 greater than one, to progressively make it more difficult to knock over all of the pins using a single projectile 12. The diameter and height of the pins 30 in the first embodiment are optimized for use in on a game board 20 with ten pins 30. Depending on the number of pins 30 used in a particular embodiment, the diameter and height of the pins 30 may be modified to optimize the game. The diameter and height of the pins 30 may also be modified depending on the intended distance between the player 15 and the front edge of the game board 20 and the intended difficulty of the game 10.

Many different types of projectiles 12 are appropriate for use in the game 10, including but not limited to, beanbags, spherical objects, elongated objects, objects with a rigid surface, objects with a soft surface, objects with a medium density surface, objects of various shapes, objects with protrusions or any other object that is capable of being tossed or thrown at the pins 30. The projectiles 12 are preferably beanbags or another flexible enclosure with a granular fill because they have enough mass to knock over the pins, are easy to throw and do not roll. The beanbags can be adjusted in terms of volume and/or weight to change the dynamics of the game 10. In some embodiments, the projectiles 12 consist of a soft, flexible enclosure and a granular fill. In some embodiments, the projectiles consist of an enclosure with a consistent texture and hardness to provide consistency when the projectile 12 contacts the game board 20 during play.

In FIG. 4 is an isometric view of a first embodiment of the target portion 11 with ten pins 30 arranged in the triangular configuration described previously. In FIG. 5 is a front elevation view of a first embodiment of the target portion 11 with ten pins 30 arranged in the aforementioned triangular configuration. In FIG. 6 is a side view of a first embodiment of the target portion 11 with ten pins 30 arranged in the aforementioned triangular configuration. The ten pins 30 are placed over the marks 21 on the upper surface of the game board 20, hiding the marks 21 in FIGS. 4-6.

Figure 7:
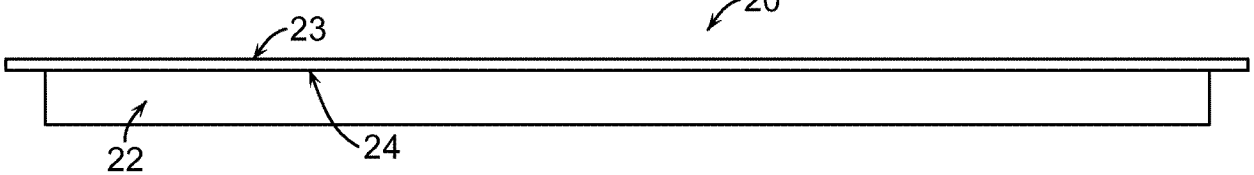
FIG. 7 is a side view of a first embodiment of the game board.

In FIG. 7 is a side view of the game board 20 without any pins 30 setup on its upper surface 23. In the first embodiment, the game board 20 has a substantially flat upper surface 23 and a support structure 22 that is mounted to the bottom surface 24 of the game board 20. The support structure 22 increases the stiffness of the game board 20 and raises the elevation of the upper surface 23 when the game board 20 is placed on a surface. In the first embodiment of the invention, the game board 20 is generally placed on the ground, which can include a surface with grass or other low lying vegetation. When the game board 20 is placed on a surface with grass or other low lying vegetation, it is desirable to elevate the upper surface 23 to a height that is equal to or greater than the height of the grass or vegetation in the vicinity of the game board 20. It is also possible to play the game 10 with grass or vegetation that exceeds the height of the upper surface 23, but the surrounding vegetation could have an impact on the trajectory of the projectiles 12.

Figure 8:
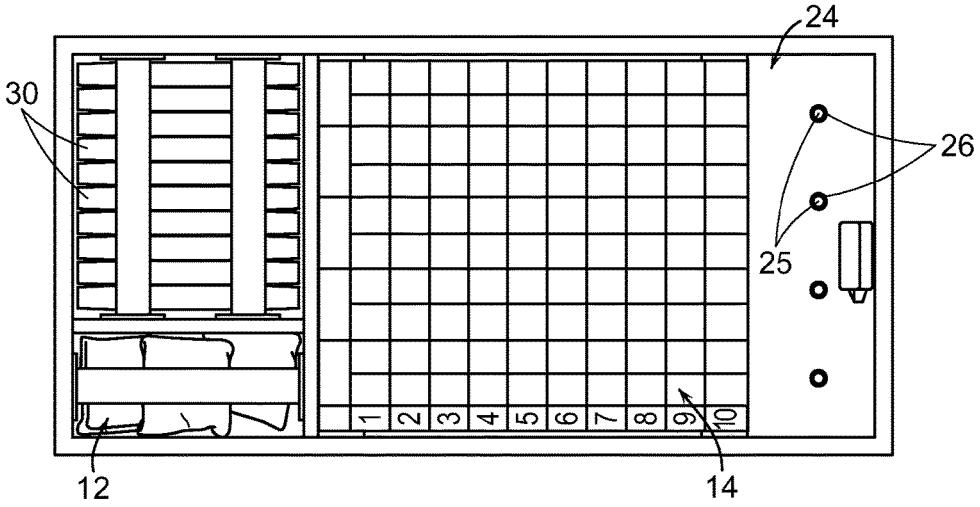
FIG. 8 is a bottom view of a first embodiment of the game board with the game components packed for transport.
Figure 9:
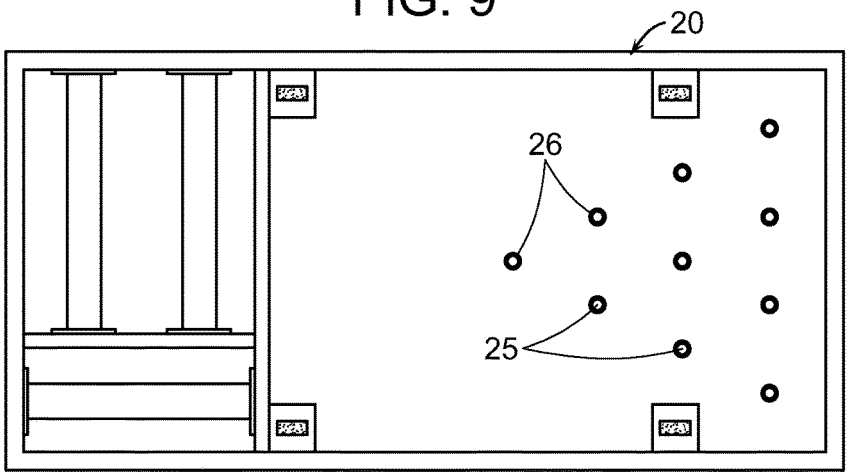
FIG. 9 is a bottom view of a first embodiment of the game board with the game components removed.

In FIGS. 8 and 9 are bottom views of the game board 20. In FIG. 8, the game board 20 is configured for transport, with game components, including the pins 30, projectiles 12 and scoreboard 14 attached to the bottom of the game board 20. In FIG. 9, the pins 30, projectiles 12 and scoreboard have been removed, showing the bare bottom of the game board 20. The bottom 24 of the game board 20 in the first exemplary embodiment uses open segmented compartments to provide uniquely sized spaces for the aforementioned components of the game during travel. The game board 20 also uses multiple elastic straps to hold the aforementioned game components in place when the game 10 is being transported. It is appreciated that the storage system disclosed on the bottom of the first embodiment of the game board 20 is one of many ways to secure the game components during transport. The game components could be transported using other methods, including but not limited to, a separate bag, a bag attached to the bottom of the board, compartments with openings, hook and loop fasteners or snap fasteners.

With the scoreboard 14 removed, a plurality of plugs 25 can be seen in FIG. 9. A single row of plugs 25 is also visible in FIG. 8, with the remainder being blocked by the scoreboard 14. In the first exemplary embodiment of the game board 20, a plurality of magnets is situated between the upper surface 23 and lower surface 24 of the game board. On the lower surface 24 of the game board 20 are a plurality of circular openings 26 that are shallower in depth than the distance between the upper surface 23 and lower surface 24. Each circular opening 26 is located substantially below a mark 21 located on the upper surface so that the center of each circular opening 26 is located below the center of a corresponding circularly shaped mark 21 on the top surface 23. Each opening 26 is sized to accept a magnet 27 that is secured in place using a plug 25. In the first exemplary embodiment, the openings 26 are circular in shape and maintain substantially the same diameter through the entire depth of each opening, however, openings of different shapes, sizes and of varying sizes could be used in some applications.

Figure 10:
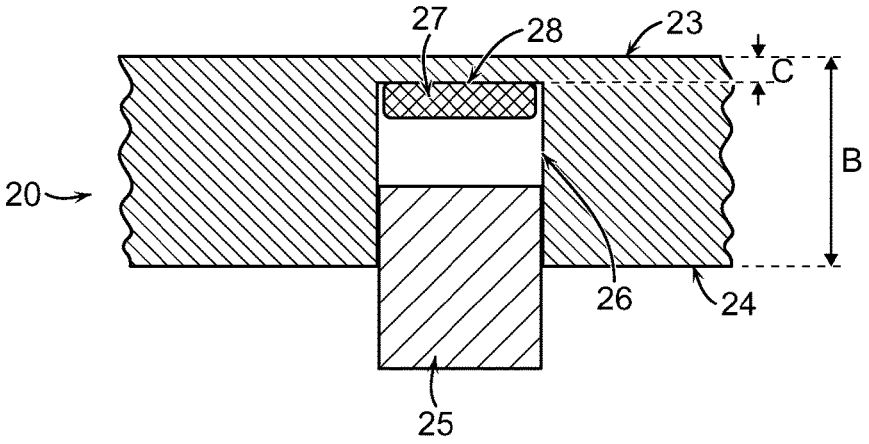
FIG. 10 is a side sectioned view of a portion of a first embodiment of the game board.

In FIG. 10 is a side sectioned view of a magnet 27 installed in the game board 20, sectioned vertically and through the center of the magnet 27. In the first embodiment of the game board 20, the depth of each opening 26 is shallower than the distance between the upper surface 23 and bottom surface 24, creating a cylindrical void with an opening on the bottom surface 24 that does not extend through the upper surface 23. The distance between the upper surface 23 and bottom surface 24 is denoted by distance B in FIG. 10. The distance between the bottom of the cylindrical void and the upper surface 23 denoted by distance C in FIG. 10. The base 28 of each opening 26 ideally should be substantially the same distance from the upper surface 23 in each opening 26 on a single game board 20 if magnets 27 of equal strength are used. In other words, distance C should be substantially the same for all openings 26 used in a single game board 20 if the magnets 27 are substantially the same strength.

Fixed to the base 28 of each opening 26 is a magnet 27. The magnets 27 of the first embodiment of the game board are rare earth magnets, neodymium (chemical formula Nd2Fe14B) magnets in particular. It is appreciated that there are other types of magnets that could be suitable for use in the present invention, including but not limited to, samarium cobalt magnets (chemical formula SmCo5), magnets created from ferromagnetic materials and electromagnets.

In the first embodiment of the game board 20, the openings 26 are circular, leading to a cylindrical void. The magnets 27 are also cylindrical to maximize the magnitude of the magnetic field at the upper surface of the game board 20, but the magnets 27 have a slightly smaller diameter than the diameter of the openings 26 (when viewed from below) to ease installation. The magnets 27 can be glued or otherwise fixed to the base 28 of each opening 26. The magnets 27 can also be secured using a plug 25, which makes independently gluing or fixing the magnets 27 to each base 28 optional. It is appreciated that the system disclosed herein of fixing a magnet to the base using glue and/or a wooden plug is one of many methods of achieving the goal of permanently mounting a magnet 27 at a predetermined depth beneath the upper surface 23. The plugs 25 can be comprised many different suitable materials, including but not limited to, wood, plastic and resin. The plugs 25 can be sanded or planed after installation to make them flush with the bottom surface 24. The magnets 27 may optionally be installed through the upper surface 23 rather than the bottom surface 24. Depending on the distance between the upper surface 23 and bottom surface 24, distance B, and the magnetic strength of the magnets 27, the magnets 27 may be mounted directly against the bottom surface 24 or in an opening 26 whose depth is equal to the height of the magnet 27, removing the need for a plug 25 at all. In some embodiments, the magnets 27 are mounted so that their upper surface is flush with the upper surface 23 of the game board 20.

Figure 11:
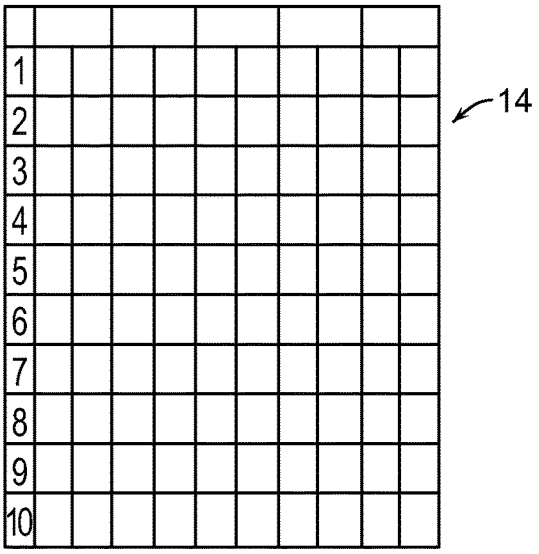
FIG. 11 is a front view of a first embodiment of the scoreboard.

In FIG. 11 is a front view of the scoreboard 14 used in the first embodiment of the game 10. The first embodiment of the game 10 uses a scoring system that is similar to that used in candlepin bowling. The scoreboard 14 is therefore similar to one that could be used in candlepin bowling. Depending on the particular sport or other basis for the design of the target portion 11, the scoreboard 14 may be adapted to the unique scoring requirements of other embodiments of the present invention. In some embodiments, the scoreboard 14 is comprised of a rigid board with a vinyl overlay to create a dry erase board.

Figure 12:
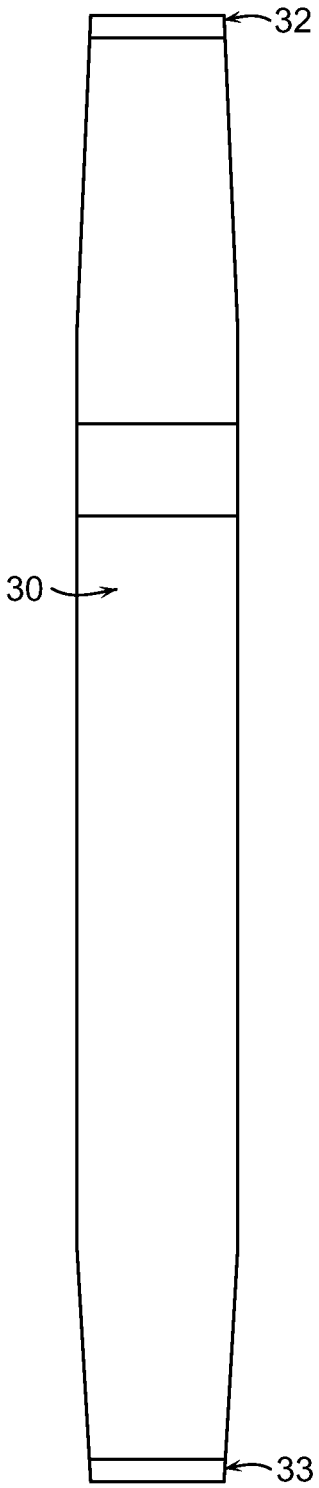
FIG. 12 is a side view of a first embodiment of a pin.
Figure 13:
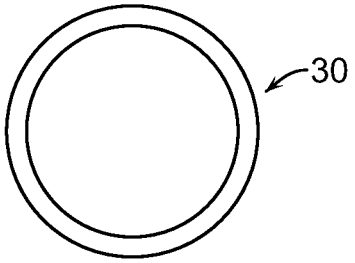
FIG. 13 is a top view of a first embodiment of a pin.

FIGS. 12-16 show the first embodiment of the pins 30 in further detail. In FIG. 12 is a side view of a pin 30, showing the general cylindrical shape of the pin with a taper at the top and bottom. In FIG. 13 is a top view of a pin 30. The bottom view of the pin 30 is substantially the same as the top view and isn't shown.

Figure 14:
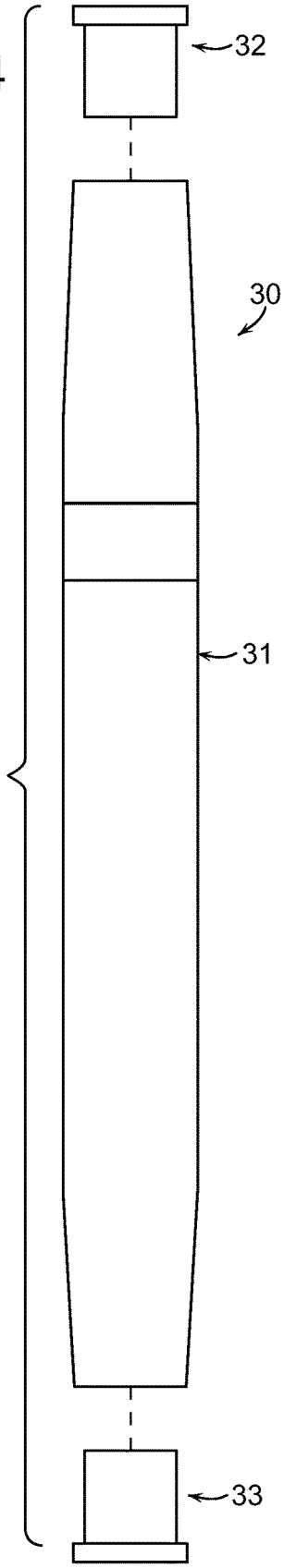
FIG. 14 is an exploded side view of a first embodiment of a pin.

In FIG. 14 is an exploded view of the first embodiment of the pins 30, showing the three main components comprising the pin 30. The pin 30 has a body 31 with an upper cap 32 and a lower cap 33, where the terms upper and lower refer to ends of the pin 30 when setup on the game board 20 and ready for play. At the upper end of the body 31 is an upper cap 32 that is fixed to the body 31. At the lower end of the body 31 is a lower cap 33 that is also fixed to the body 31.

Figure 15:
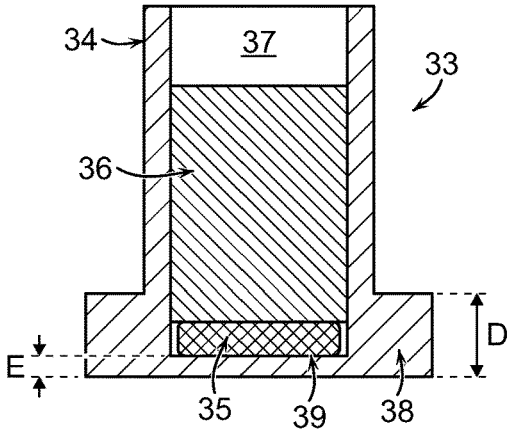
FIG. 15 is a side sectioned view of the lower endcap of the first embodiment of a pin.
Figure 16:
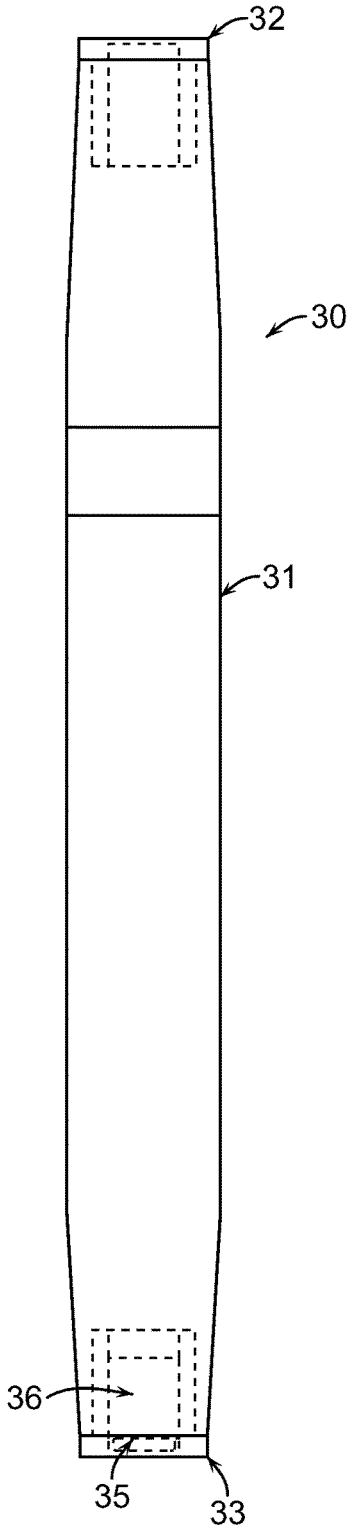
FIG. 16 is a side view of a first embodiment of a pin with dashed lines showing hidden features of the pin.

In FIG. 15 is a side sectioned view of a lower cap 33, showing the multiple components that comprise it. The lower cap 33 is comprised of an endcap 34, a magnet 35 and a plug 36. The endcap 34 is comprised of a cylindrical base 38 and a hollow cylinder 37 that extends vertically from the base 38. The thickness of the base 38 is denoted by distance D. The upper cap 32 is similar to the endcap 34 of the lower cap 33, expect that it is inverted when installed and the area of the upper cap 32 that corresponds to the base 38 of the lower cap is uniform in height (substantially equal to distance D in all areas).

The base 38 in the lower cap 34 is not a uniform height, rather, the base 38 has a cylindrical void 39 that is open to the hollow cylinder 37. The bottom of the cylindrical void 39 is substantially flat and is a distance E from the bottom of the base 38. Situated within the cylindrical void 39 is a magnet 35 fixed to the bottom of the cylindrical void 39. The magnets 35 of the first embodiment of the pins 30 are rare earth magnets, neodymium (chemical formula Nd2Fe14B) magnets in particular. It is appreciated that there are other types of magnets that could be suitable for use in the present invention, including but not limited to, samarium cobalt magnets (chemical formula SmCo5), magnets created from ferromagnetic materials and electromagnets.

In some embodiments, the magnets 27 & 35 comprise grade N52 neodymium rare earth magnets oriented in their respective location to cause the base of the pin 30 to be magnetically attracted to a location on the game board 20. In some embodiments, distance C (in FIG. 10) and distance E (in FIG. 15) are substantially the same. In some embodiments, distance C and distance E are between and including 0.005 inches and 0.200 inches. In some embodiments, distance C and distance E are between and including 0.010 inches and 0.150 inches. In some embodiments, distance C and distance E are between and including 0.020 inches and 0.100 inches. In some embodiments, distance C and distance E are between and including 0.030 inches and 0.050 inches. In some embodiments, distance C and distance E are both about 0.040 inches.

In some embodiments, the use of magnets 27 & 35 in both the pins 30 and game board 20 provide a more consistent and stronger force of magnetic attraction between the respective components than in embodiments where one magnet is replaced with a ferrous material. In some embodiments, the magnets 27 & 35 each comprise a single neodymium magnet that is cylindrical in shape. In some embodiments, it is desirable for there to be a significant force of magnetic attraction between the magnets 27 & 35 in their respective game board 20 and pin 30 during play to prevent the pins 30 from falling over upon incidental contact. For example, if the force of magnetic attraction between the magnets 27 & 35 is not adequate, the shock of a projectile 12 impacting the game board 20 could knock over all of the pins 30. With an adequate force of magnetic attraction between the magnets 27 & 35, a projectile 12 can generally only knock over a pin 30 through direct contact.

In the first embodiment of the pins 30, the magnets 35 are cylindrical in shape with a slightly smaller diameter (when viewed from above) than the diameter of the hollow cylinder 37, for ease of installation. The magnets 35 can be glued or otherwise fixed to the bottom of the cylindrical voids 39. The magnets 35 can also be secured using a plug 36, which makes independently gluing or fixing the magnets 35 to the bottom of each cylindrical void 39 optional. It is appreciated that the system disclosed herein of fixing a magnet to the bottom of the cylindrical void using glue and/or a plug is one of many methods of achieving the goal of permanently mounting a magnet 35 at a predetermined distance E away from the bottom of the lower cap 33. The plugs 36 can be comprised of many different suitable materials, including but not limited to, wood, plastic and resin. The magnets 35 may optionally be installed through the bottom surface of the lower cap 33 rather than through the hollow cylinder 37. Depending on distance E, the magnetic strength of the magnets 35 and size of the magnets 35, the magnets 35 may be mounted directly against the bottom surface of the lower cap or in a recess in the bottom surface of the lower cap 33.

The magnet 35 in the exemplary embodiment of a pin 30 is mounted internally to the pin 30, in part, to increase durability. Rare earth magnets can be relatively brittle and enclosing the magnets 35 within the pin 30 can increase the durability of the pins 30 and prevent the magnet 35 from cracking or breaking away from the pin 30. The use of an end cap 34 on the pin 30 is particularly effective at preventing damage to the magnet 35 during play. The end cap 34 protects the bottom of the magnet 35 with the material contained in distance E. The magnet 35 can be secured in place both with an interference fit between the diameter of the magnet 35 and the diameter of the hollow cylinder 37 and through the use of a plug 36 to prevent the magnet 35 from upward movement relative to the pin 30. The plug 36 may also be secured with an interference fit between the diameter of the plug 36 and the diameter of the hollow cylinder 37. The magnet 35 and the plug 36 may optionally be fixed relative to the hollow cylinder 37 using an adhesive.

the magnets 35 are cylindrical in shape with a slightly smaller diameter (when viewed from above) than the diameter of the hollow cylinder 37, for ease of installation. The magnets 35 can be glued or otherwise fixed to the bottom of the cylindrical voids 39. The magnets 35 can also be secured using a plug 36, which makes independently gluing or fixing the magnets 35 to the bottom of each cylindrical void 39 optional. It is appreciated that the The pins 30 are placed on the game board 20 directly on each mark 21 prior to the beginning of play. Because the lower end of each pin 30 has a magnet 35 situated within the lower endcap and each mark 21 has a magnet 27 mounted beneath the upper surface 23 of the game board 20, the lower end of each pin 30 is magnetically attracted to marks 21. Because the game board 20 also uses magnets 27, the north and south poles of the magnets 27 and 35 must be considered to ensure that the magnets 27 in the game board 20 are magnetically attracted to the magnets 35 in the pins 30 rather than repelled. While magnets are used in both the game board 20 and pins 30 in the present embodiment, the magnets in either the pins or the game board may be substituted with ferrous metal or another material that is attracted to magnets. The upper cap may also be substituted with a second lower cap so that both ends of the pin 30 have an area that is magnetically attracted to the game board 20.

The relationship between the weight of the pins 30, the center of mass of the pins 30 and the force of attraction between the base of the pins 30 and the game board 20 at marks 21 on the upper surface 23 is important to the game 10. For a given weight and center of mass of a pin 30, the force of attraction can be varied to change the dynamics of the game. When the force of attraction is increased between the pins 30 and the game board 20, the pins 30 are more difficult to knock over, making them less likely to fall over from disturbances caused by impacts against the game board 20 or by contact from other pins 30. When the force of attraction is decreased, the pins 30 are easier to knock over, making them more likely to fall over from disturbances caused by impacts against the game board 20 or contact from other pins 30. In the first exemplary embodiment of the present invention, the force of magnetic attraction between the base of the pins 30 and the game board 20 at marks 21 is optimized so that the pins 30 will fall over from direct hits by a projectile 12 or significant impacts from other pins 30, but not from disturbances against the game board 20 itself. The force of magnetic attraction can be adjusted by changing distance C and/or distance E or changing the characteristics of magnet 27 and/or magnet 35. Lightening the weight of the pins 30 would have a similar effect as increasing the magnetic force between the base of the pins 30 and the game board 20. Increasing the weight of the pins 30 would have a similar effect as decreasing the magnetic force between the base of the pins 30 and the game board 20. Decreasing the height of the center of mass of the pins 30 would have a similar effect as increasing the magnetic force between the base of the pins 30 and the game board 20. Increasing the height of the center of mass of the pins 30 would have a similar effect as decreasing the magnetic force between the base of the pins 30 and the game board 20.

In one example of the present invention, the magnetic force between the base of the pins 30 and the game board 20 is optimized so that the pins 30 will return to the upright position if tilted at an angle of less than ten degrees from upright. In another example of the present invention, the magnetic force between the base of the pins 30 and the game board 20 is optimized so that the pins 30 will return to the upright position if tilted at an angle of less than twenty degrees from upright.

Figure 17:
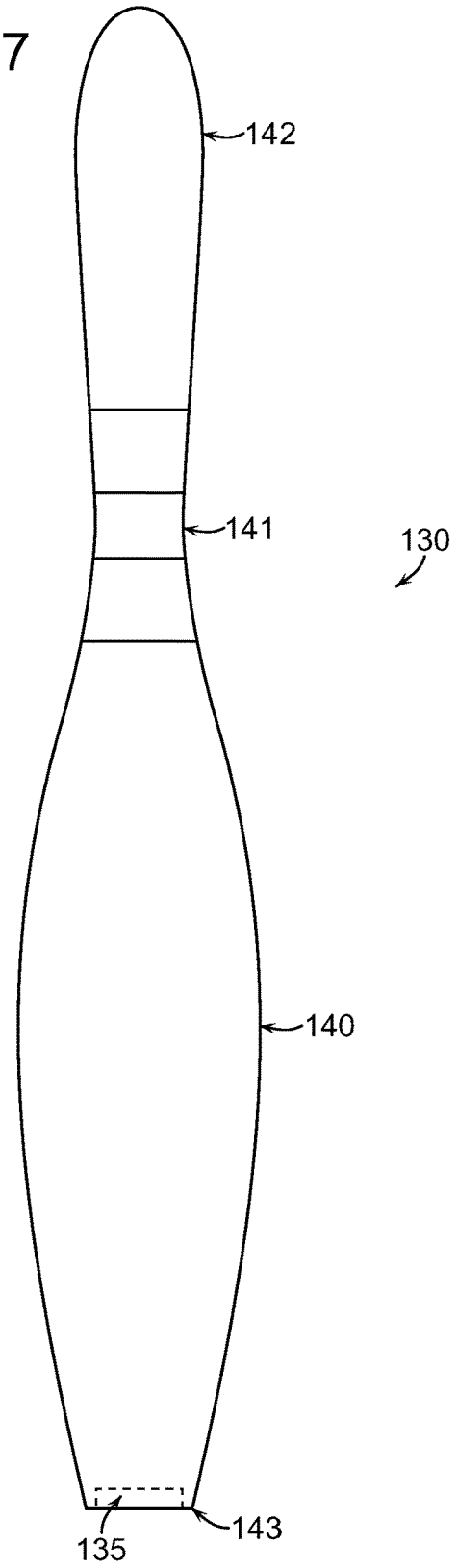
FIG. 17 is a side view of a second embodiment of a pin with dashed lines showing hidden features of the pin.

In FIG. 17 is a side view of a second exemplary embodiment of a pin 130. The second exemplary embodiment of a pin 130 is styled to call to mind a ten pin style bowling pin that has a wide lower area 140, narrow neck 141, widening to a rounded head 142. In the second embodiment of a pin 130, the pin 130 is generally cylindrical, but the diameter of the pin is continuously and marginally changing so that the diameter of the pin does not remain constant at any location moving up or down the pin 130. The pin 130 has a magnet 135 embedded in its base that is hidden in a side view and therefore shown with dashed lines. In this embodiment, the magnet 135 is mounted in a recessed area 143 in the base of the pin 130 so that the magnet 135 is either flush with the base of the pin 130 or slightly recessed. The pin 130 can be solid or hollow depending on the material chosen. A hollow design would have a lower weight and center of mass compared to a solid design of a similar material, requiring the strength of the magnet 135 to be adjusted using the same principles taught for pin 30.

In some embodiments, the game 10 is useful to provide a bowling type game without the need for a long alley or runway. By utilizing a target portion 10 spaced away from a foul line 13 and projectiles 12 configured for being lobbed, the game 10 eliminates the need for a perfectly flat surface required when rolling a projectile towards a target.

In some embodiments, the game board 20 is configured so that it is elongate in a direction away from a foul line 13, with a length in the elongate direction that is about two times its width in a direction normal to the elongate direction. In some embodiments, the game board 20 is configured so that it is elongate in a direction away from a foul line 13, with a length in the elongate direction that is between and including one times to four times its width in a direction normal to the elongate direction. In some embodiments, the game board 20 is configured with a target area on the distal end relative to the foul line 13 and a substantially flat area on the proximate end relative to the foul line 13. In some embodiments, the target area and substantially flat area have substantially the same area. In some embodiments, the target area and substantially flat area have a substantially similar length and width, where the length and width are about the same. The target area, in some embodiments, is defined by the area of the game board 20 configured to accept the placement of pins 30.

In some embodiments, the foul line 13 is spaced away from the game board 20 so that a user standing on one side of the foul line 13 would need to lob a projectile 12 over a lateral gap between the foul line 13 and the game board 20 to strike a pin 30. The lateral gap does not need to be perfectly flat, making the game 10 ideal for play over uneven ground.

In some embodiments, the projectiles 12 comprise a soft enclosure filled with a weighted material. The projectiles 12 are preferably constructed with a soft enclosure covering their entire exterior so that they can easily deform on impact with the game board 20 or pins 30. In some embodiments, the projectiles 12 preferably do not have any substantially rigid areas on their enclosure to prevent unpredictable results when the projectile 12 impacts the game board 20 or pins 30. A projectile 12 with a rigid portion on its enclosure could bounce or slide off the game board 20 in an unpredictable manner, making it less desirable for some embodiments of the game 10.

It is also preferable for the support structure 22 to have a length and width that is less than the upper surface 23 of the game board 20. Since a projectile 12 can strike the leading edge or the sides of the game board 20, it is preferable to have the support structure 22 recessed from the leading edge (proximate end) or sides of the game board.

The embodiments of the game 10 disclosed herein can be used in a method of play that enhances player enjoyment. The lawn games of the prior art that call to mind the game of bowling are tedious and frustrating to play due to the unpredictable action of a rolled ball on the ground and the need to reset the pins precisely after each turn. The present invention can be played with as few as one player, however, it is preferable to play the game with at least two players to enhance the playing experience with a direct-competition component. Potentially, an infinite number of players could participate in a single game, however, it is preferable to limit the number of players to a reasonable number so each round does not take more time than the attention span of the players. The game consists of ten rounds, where each player has one turn during each round. While the preferred embodiment uses ten rounds, the number of rounds may be increased or decreased based on player preferences.

Prior to playing the first round, the game board must be placed on the ground. It is preferable to place the game board on a relatively level area, however, there is no requirement that the ground be absolutely level. Depending on player preference, the game board could be placed on an incline or inclined using an additional support or leg. At a predetermined distance from the front edge of the game board, two foul line flags are pressed into the ground to mark a foul line that is substantially parallel to the front edge of the game board. The foul line does not need to be precisely parallel to the front edge of the game board, however, it is preferable to have the foul line as close to parallel to the front edge of the game board as practical. The flags should be spaced apart to sufficiently mark the foul line and provide a comfortable area for a player to toss projectiles. While the present invention uses small flags attached to thin metal poles to mark the foul line, it is appreciated that there are a variety of methods and objects that could be used to mark the foul line, including but not limited to, paint or objects placed on the ground.

In one example, the foul line is 25 feet from the front edge of the game board. The distance between the foul line and the front edge of the game board can be increased to increase difficulty or decreased to decrease difficulty. In another example, the foul line continues in a straight line beyond the flags marking the foul line so that a player may throw a projectile from any point behind a foul line of infinite length.

Once the game board and foul line are set, the pins are setup on the game board for the start of a player's turn. In the preferred embodiment, there are ten pins with magnets mounted near their base and ten magnets embedded in the surface of the game board. To set the pins up, a person merely needs to turn the pins upright (with the magnets towards the bottom) and place them on the game board in the vicinity of an embedded magnet. The magnetic attraction between the magnet in the pin and the game board causes the pin to slide to the correct position and remain upright respite minor disturbances. Once all ten pins are set up with the magnet in each base placed near a magnet in the game board, a player's turn is ready to begin.

To begin a turn, the player stands behind the foul line so that the foul line is situated between the player and the game board. The player has three beanbags available to use as a projectile, the object being to throw the bean bags at the pins to knock them over. While most players will likely use an under handed throw to lob the beanbags at the pins, many different styles of throwing may be used by a player, including but not limited to, an overhand throw, a sidearm throw, a shotput-type throw or a discus-like throw. After a player throws all three beanbags, the player's score is computed as the number of pins that were knocked over. In one example, the beanbags and fallen pins are not removed from the game board during a player's turn so that all three beanbags are thrown without removing beanbags and/or fallen pins between throws. In another example, the beanbags and/or fallen pins are removed from the game board during a player's turn so that beanbags and/or fallen pins are removed from the game board between a player's throws.

While each player has three beanbags available during each turn, a player gains a future benefit in the game if less than three beanbags are needed to knock down all of the pins. If only one or two beanbags is needed to knock over the pins, the player may add to their score in the next round. If two beanbags were needed to knock down all of the pins, the player would add the number of pins knocked down by their first beanbag thrown in the next round to their score. If only one beanbag was needed to knock down all of the pins, the player would add the number of pins knocked down by their first and second beanbag thrown in the next round to their score. If the player knocks down all of the pins with fewer than three beanbags in the tenth, or final round, they will be entitled to an additional round for the purpose of counting the number of pins knocked over in the first beanbag thrown or the first and second beanbag thrown, as appropriate.

During each round, each player has a turn, where the pins must be reset on the game board and the beanbags returned to the vicinity of the foul line. The score of each player can be recorded on a scoreboard or any other suitable means for recording or remembering the score of each player. Keeping score is an optional aspect of the game as some players may find the game more enjoyable without a competitive aspect. After ten rounds, the player with the highest numerical score is the winner of the game.

In an alternative method, the game can be played with each player having two beanbags available during each turn, similar to the rules of ten pin bowling. The method of play and scoring would be substantially similar, except that each player would only be able to throw two beanbags in a turn rather than three. When using only two beanbags per turn, the rules applicable for players that knock over all of the pins with three beanbags are inapplicable. For players that knock over all of the pins with two beanbags, they would be entitled to add the number of pins knocked over by their first beanbag in the next round to their score. The game could also be played with fewer than two beanbags or more than three beanbags as preferable to the players.

What has been described is a projectile and target lawn game and methods of playing the projectile and target lawn game to maximize player enjoyment. While this disclosure shows the invention as a projectile and target lawn game that calls to mind the sport of bowling, all or part of the invention is capable of being used in other applications. In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A projectile and target game comprising:

a platform;

a first target; and a first projectile;

and wherein:

the platform comprises a planar upper surface that is elongate in a direction away from a user with a proximate portion and a distal portion relative to the user;

wherein the planar upper surface of the platform has a length in the elongate direction that is between and including one to four times a width in a direction normal to the elongate direction;

wherein the planar upper surface is configured to be held in a substantially horizontal position by supports extending downward relative to the planar upper surface;

wherein the first projectile comprises an enclosure containing a fill material;

wherein the first target has an upper end and a lower end and is elongate in a top to bottom direction;

wherein the lower end of the first target is configured with a force of magnetic attraction to a location on the distal portion of the platform;

wherein the force of magnetic attraction is configured so that the target remains standing when the edge of the platform is struck by a projectile;

wherein the first target further comprises a magnet fixed at a distance E from said first end; wherein the first end of each target is configured to locate the target relative to the upper surface; and wherein E is greater than zero;

wherein the platform further comprises one or more magnets fixed at a distance C from said upper planar surface and oriented so as to magnetically attract the magnet contained in the first target wherein distance E and distance C are between and including 0.030 inches and 0.050 inches and wherein the magnets comprise rare earth magnets; and wherein the magnetic attraction is configured to urge the first target to return to an upright position if the distal end is displaced at an angle of less than ten degrees from the upright position.

2. A projectile and target game comprising:

a platform;

a first target; and a first projectile;

and wherein:

the platform comprises a planar upper surface that is elongate in a direction away from a user with a proximate portion and a distal portion relative to the user;

wherein the planar upper surface of the platform has a length in the elongate direction that is between and including one to four times a width in a direction normal to the elongate direction;

wherein the planar upper surface is configured to be held in a substantially horizontal position by supports extending downward relative to the planar upper surface;

wherein the first projectile comprises an enclosure containing a fill material;

wherein the first target has an upper end and a lower end and is elongate in a top to bottom direction;

wherein the lower end of the first target is configured with a force of magnetic attraction to a location on the distal portion of the platform;

wherein the force of magnetic attraction is configured so that the target remains standing when the edge of the platform is struck by a projectile;

wherein the first target further comprises a magnet fixed at a distance E from said first end; wherein the first end of each target is configured to locate the target relative to the upper surface; and wherein E is greater than zero;

wherein the platform further comprises one or more magnets fixed at a distance C from said upper planar surface and oriented so as to magnetically attract the magnet contained in the first target wherein distance E and distance C are between and including 0.030 inches and 0.050 inches and wherein the magnets comprise rare earth magnets; and wherein the magnetic attraction is configured to urge the first target to return to an upright position after the distal end is displaced at an angle of between ten and twenty degrees from the upright position.

* * * * *